US012768227B2

(12) United States Patent
Morrison et al.

(10) Patent No.: US 12,768,227 B2
(45) Date of Patent: Oct. 20, 2026

(54) STAGE TOOL ASSEMBLY WITH CONTROL LINE PROTECTOR AND METHOD OF CEMENTING A WELLBORE

(71) Applicant: FORUM US, INC., Houston, TX (US)

(72) Inventors: Jeffery Morrison, Missouri City, TX (US); Andrew Webber, Hockley, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 19/458,292

(22) Filed: Jan. 23, 2026

(65) Prior Publication Data

US 2026/0168334 A1 Jun. 18, 2026

Related U.S. Application Data

(62) Division of application No. 18/946,532, filed on Nov. 13, 2024, now Pat. No. 12,584,359.

(60) Provisional application No. 63/598,828, filed on Nov. 14, 2023.

(51) Int. Cl.

| | |
|---|---|
| ***E21B 34/06*** | (2006.01) |
| ***E21B 17/02*** | (2006.01) |
| ***E21B 33/14*** | (2006.01) |
| ***E21B 47/017*** | (2012.01) |

(52) U.S. Cl.

CPC ..... *E21B 17/026* (2013.01); *E21B 33/14* (2013.01); *E21B 34/06* (2013.01); *E21B 47/017* (2020.05)

(58) Field of Classification Search

CPC ..... E21B 33/14; E21B 34/06; C09K 8/34
USPC ..... 166/250.01
See application file for complete search history.

(56) References Cited

U.S. PATENT DOCUMENTS

| | | | | |
|---|---|---|---|---|
| 2,829,190 | A | 4/1958 | Comlossy, Jr. | |
| 4,603,737 | A | 8/1986 | Spikes | |
| 5,973,270 | A | 10/1999 | Keller | |
| 6,929,065 | B2 | 8/2005 | Cannon | |
| 7,134,455 | B2 | 11/2006 | Hickman et al. | |
| 10,197,190 | B1 | 2/2019 | Neff | |
| 10,669,835 | B2 | 6/2020 | Jaaskelainen | |
| 11,719,051 | B2 | 8/2023 | Pronk | |
| 11,811,206 | B1 | 11/2023 | Sherriffs | |
| 2004/0221997 | A1* | 11/2004 | Giroux | E21B 33/143 166/380 |

(Continued)

OTHER PUBLICATIONS

PCT International Search Report and Written Opinion dated Feb. 18, 2025, for International Application No. PCT/US2024/055729.

*Primary Examiner* — William D Hutton, Jr.
*Assistant Examiner* — Ashish K Varma
(74) *Attorney, Agent, or Firm* — Patterson + Sheridan, LLP

(57) ABSTRACT

A stage tool assembly comprises a stage tool and a control line protector. The stage tool comprises a plurality of port holes disposed through an outer surface of a body, and a plurality of securing pin holes disposed on the outer surface of the body. The control line protector comprises a first collar, a second collar, and a rib coupled to the first collar and the second collar. The stage tool assembly also comprises a plurality of control lines that are configured to supply power to one or more sensors disposed on the outer surface of the body, and the control lines are disposed between the rib and the outer surface of the body. The stage tool assembly also comprises a plurality of securing pin members disposed in the plurality of securing pin holes to prevent the control line protector from moving relative to the body.

20 Claims, 4 Drawing Sheets

(56) References Cited

U.S. PATENT DOCUMENTS

| | | | | |
|---|---|---|---|---|
| 2011/0006512 | A1 | 1/2011 | James et al. | |
| 2016/0069141 | A1* | 3/2016 | Blackmon | E21B 17/006<br>166/380 |
| 2016/0097243 | A1 | 4/2016 | Noakes et al. | |
| 2020/0032593 | A1 | 1/2020 | Serafinchan | |
| 2020/0158206 | A1* | 5/2020 | Banks | E21B 17/1035 |
| 2023/0048397 | A1* | 2/2023 | AlOmair | E21B 33/146 |
| 2024/0254843 | A1 | 8/2024 | Lunde | |

* cited by examiner

STAGE TOOL ASSEMBLY WITH CONTROL LINE PROTECTOR AND METHOD OF CEMENTING A WELLBORE

CROSS-REFERENCE TO RELATED APPLICATIONS

This application claims benefit of U.S. patent application Ser. No. 18/946,532, filed Nov. 13, 2024, which claims benefit of United States provisional patent application Ser. No. 63/598,828, filed Nov. 14, 2023. Each of the aforementioned related patent applications is herein incorporated by reference in its entirety.

BACKGROUND

Field

Aspects of the present disclosure relate to a control line protector for use with a stage tool assembly for cementing a wellbore.

Description of the Related Art

Control lines are often lowered into a wellbore along an outer surface of a drill or cementing string assembly. The control lines are used to supply power to one or more downhole devices. The control lines can potentially be damaged when pinched between the outer surface of the string assembly and the inner surface of the wellbore. In addition, control lines can be damaged when pumping cement into the wellbore through the string assembly.

Therefore, there is a need for new and/or improved tools and methods for protecting such control lines.

SUMMARY

In one embodiment, a stage tool assembly comprises a stage tool, comprising a body having a bore; a plurality of port holes disposed through an outer surface of the body; and a plurality of securing pin holes disposed on the outer surface of the body; a control line protector, comprising a first collar and a second collar; and a rib coupled to the first collar and the second collar; a plurality of control lines are configured to supply power to one or more sensors and are disposed between the rib and the outer surface of the body the one or more sensors disposed on an outer surface of the body; and a plurality of securing pin members disposed in the plurality of securing pin holes to prevent the control line protector from moving relative to the body.

In one embodiment, a method of cementing a wellbore comprises lowering a stage tool assembly into the wellbore, wherein the stage tool assembly comprises a stage tool, a control line protector coupled to the stage tool, a plurality of control lines disposed between the control line protector and the stage tool, one or more sensors coupled to the plurality of control lines, and one or more securing pin members disposed in an outer surface of the stage tool that prevent rotation of the control line protector relative to the stage tool; opening a plurality of port holes of the stage tool to allow fluid flow through the plurality of port holes; pumping cement through the stage tool assembly and out of the plurality of port holes and into the wellbore; and closing the plurality of port holes of the stage tool to prevent fluid flow through the plurality of port holes.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

FIGS. 1A-3 illustrate one embodiment of a stage tool assembly 100. Only a portion of the stage tool assembly 100 is shown in FIGS. 1A-3. The stage tool assembly 100 may be part of a drill or cementing string assembly that comprises multiple pipes and/or multiple other tool assemblies coupled together for drilling or cementing a wellbore. The drill or cementing string assembly may also comprise one or more stage tool assemblies 100 coupled together.

Figure 1A:
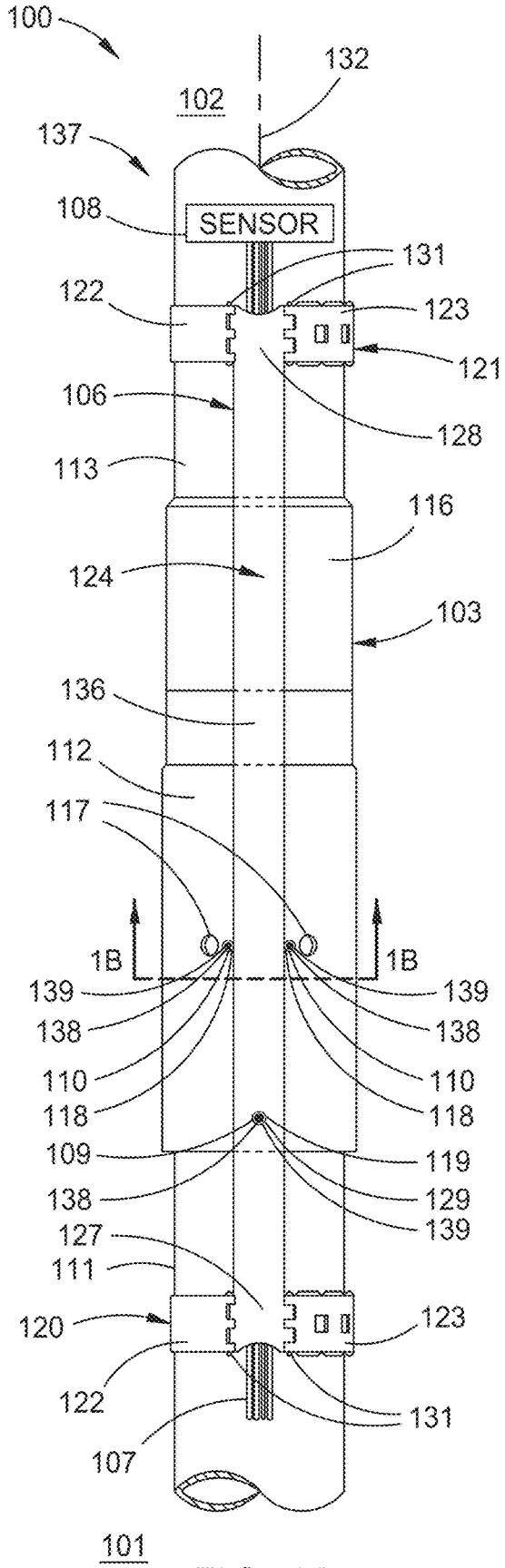
FIG. 1A is a top view of a stage tool assembly, according to one embodiment.
Figure 1B:
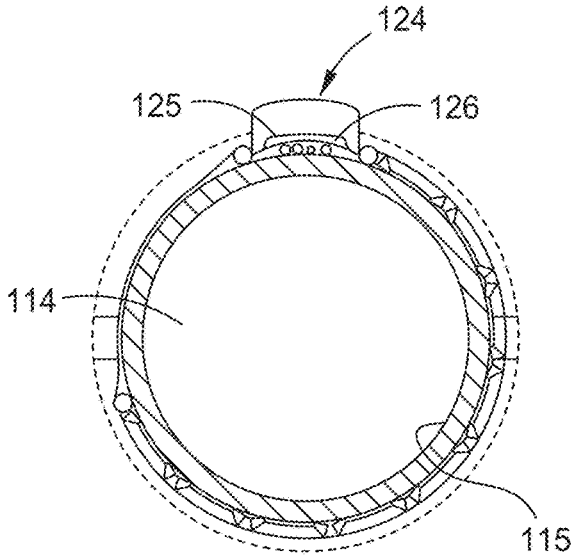
FIG. 1B is a cross sectional view of the stage tool assembly, according to one embodiment.

Referring to FIGS. 1A and 1B, the stage tool assembly 100 has an uphole side 101 and a downhole side 102. The stage tool assembly 100 comprises a stage tool 137 which may comprise a body 103. The stage tool assembly 100 may further comprise a control line protector 106, a plurality of control lines 107, one or more sensors 108, a plurality of securing pin members 138, a first blocking member 104, and a second blocking member 105.

The body 103 may comprise a first body portion 111, a second body portion 112, and a third body portion 113. The first, second, and/or third body portions 111, 112, 113 may be coupled together and/or integrally formed together at a unitary body. The second body portion 112 is disposed between the first body portion 111 and the third body portion 113. The second body portion 112 may have a larger outer diameter than the first body portion 111 and the third body portion 113. The second body portion 112 may have multiple outer diameters portions. The body 103 further comprises a bore 114 disposed therethrough with an inner surface 115. The body 103 further comprises an outer surface 116.

The body 103 may also comprise a plurality of port holes 117. The plurality of port holes 117 extend through the body 103. The plurality of port holes 117 extend from the inner surface 115 to the outer surface 116. The plurality of port holes 117 may be located on the second body portion 112. In one or more embodiments, the plurality of port holes 117 may be located on the first body portion 111 or on the third body portion 113. The plurality of port holes 117 may be located on the body 103 such that fluid is permitted to flow through the bore 114 and out of the plurality of port holes 117 without interfering with other functions of the stage tool assembly 100.

The body 103 may also comprise a plurality of securing pin holes 139. The plurality of securing pin holes 139 may be configured to receive a plurality of securing pin members 138. The plurality of securing pin members 138 may comprise at least one axial securing pin member 109 and a plurality of rotational securing pin members 110. The securing pin members 138 may be disposed in the securing pin holes 139 and coupled to the securing pin holes 139 by methods including, but not limited to, threading, welding, brazing, cementing, fastening, or press fitting.

The plurality of securing pin holes 139 may further comprise a plurality of rotational securing pin holes 118 disposed on the outer surface 116 of the body 103. The plurality of rotational securing pin holes 118 may be one or more blind holes that do not extend all the way through the wall thickness of the body 103. The plurality of rotational securing pin holes 118 may be through holes that do extend all the way through the wall thickness of the body 103 but are sealed so that the plurality of rotational securing pin holes 118 do not create a leak path from the bore 114 to the outer surface 116 of the body 103. The plurality of rotational securing pin holes 118 may be located on the outer surface 116 of the body 103 in any location so long as they do not create a leak path from the bore 114 to the outer surface 116. The plurality of rotational securing pin holes 118, in combination with the plurality of rotational securing pin members 110, rotationally secure the control line protector 106 and the plurality of control lines 107 to the body 103 (e.g. prevent the control line protector 106 and the plurality of control lines 107 from rotating about the body 103). In one or more embodiments, the plurality of rotational securing pin holes 118 may be located at the same axial position with respect to the body 103 as the plurality of port holes 117. In one or more embodiments, each of the plurality of rotational securing pin holes 118 may be in different axial positions with respect to one another. In one or more embodiments, each of the plurality of securing pin holes 139 maybe in different axial locations with respect to the body 103 and the plurality of port holes 117. In one or more embodiments, the plurality of rotational securing pin holes 118 are located on both sides of a rib 124 of the control line protector 106. In one or more embodiments, the plurality of rotational securing pin holes 118 may be located in a place such that the plurality of rotational securing pin members 110 are disposed through, or integrated with, the rib 124.

The plurality of securing pin holes 139 comprises at least one axial securing pin hole 119 disposed on the outer surface 116 of the body 103. The at least one axial securing pin hole 119 may be one or more blind holes that do not extend all the way through the wall thickness of the body 103. The at least one axial securing pin hole 119 may be a through hole that does extend all the way through the wall thickness of the body 103 but is sealed so that the axial securing pin hole 119 does not create a leak path from the bore 114 to the outer surface 116 of the body 103. The at least one axial securing pin hole 119 may be located on the outer surface 116 of the body 103 in any location so long as it does not create a leak path from the bore 114 to the outer surface 116. The at least one securing pin hole 119, in combination with the at least one axial securing member 109, axially secures the control line protector 106 and the plurality of control lines 107 to the body 103 and prevents axial movement of the control line protector 106 with respect to the body 103. In one or more embodiments, the axial securing pin hole 119, in combination with the at least one axial securing member 109, may also rotationally secure the control line protector 106 and the plurality of control lines 107 preventing rotation with respect to the body 103. In one or more embodiments, the at least one axial securing pin hole 119 may be in the same axial position with respect to the body 103 as the plurality of port holes 117. In one or more embodiments, the at least one axial securing pin hole 119 may be in the same axial position with respect to the body 103 as the plurality of rotational securing pin holes 118. In one or more embodiments, the at least one axial securing pin hole 119 may be in a different axial position with respect to the body 103 as the plurality of port holes 117 and the plurality of rotational securing pin holes 119.

The control line protector 106 may comprise a first collar 120 coupled to a second collar 121 by a rib 124. The first collar 120 and second collar 121 may each comprise a first clamp 122 and a second clamp 123. The first clamp 122 and the second clamp 123 of the first collar 120 may be coupled to each other at one end of the rib 124, and the first clamp 122 and the second clamp 123 of the second collar 121 may be coupled to each other at the opposite end of the rib 124. The first collar 120 and the second collar 121 may clamp against the outer surface 116 of the body 103. The clamping force may be sufficient to prevent the first collar 120 and the second collar 121 from moving axially and rotationally with respect to the body 103.

The rib 124 comprises a channel 125 and an outer surface 136. The shape of the channel 125 may include, but is not limited to, a U-shape, a C-shape, and a square-shape. The channel 125 and the outer surface 116 of the body 103 create a cavity 126, through and within which the plurality of control lines 107 are located. The cavity 126 prevents the plurality of control lines 107 from moving outside of the cavity 126. The rib 124 prevents the control lines 107 from being pinched, cut, eroded, or otherwise be damaged while being lowered into a wellbore. The rib 124 also secures the control lines 107 in the desired rotational position with respect to the body 103. It may be desired to keep the control lines 107 away from the plurality of port holes 117, or protrusions or other portions of the body 103 that may also damage the control lines 107.

The rib 124 may have a first end 127 and a second end 128. The first end 127 may be coupled to the first collar 120 by one or more hinge pins 131, and the second end 128 may be coupled to the second collar 121 by one or more hinge pins 131. The rib 124 may also comprise at least one rib axial securing pin hole 129, which, in combination with the at least one axial securing pin hole 119 and the at least one axial securing pin member 109, prevent axial movement of the rib 124, the control line protector 106, and the plurality of control lines 107 with respect to the body 103. The at least one rib axial securing pin hole 129, in combination with the at least one axial securing pin hole 119 and the at least one axial securing pin member 109, may also prevent rotational movement of the rib 124, the control line protector 106, and the plurality of control lines 107 with respect to the body 103. The rib 124 may be made of a metallic or composite material.

The rib 124 may be rotationally fixed by the plurality of rotational securing pin members 110. In one or more embodiments, the rib 124 is rotationally fixed by the plurality of rotational securing pin members 110, which contact opposing edges of the rib 124. In some embodiments, the rib 124 is rotationally fixed by the plurality of rotational securing pin members 110 by a hole and fastener connection. In some embodiments, the rib 124 is rotationally fixed by the plurality of rotational securing pin members 110 by threaded connection. In some embodiments, the rib 124 is rotationally fixed by the plurality of rotational securing pin members 110 by clamp force. In one or more embodiments, the rotational securing pin members 110 may be integral to the control line protector 106 or the body 103. The plurality of rotational securing pin members 110 may be, but are not limited to, clamp, a body, a fastener, a pin, a bolt, a set screw, or a screw.

The at least one axial securing member 109 may be disposed in the at least one rib axial securing pin hole 129 and the at least one axial securing pin hole 119. The at least one axial securing member 119 may be configured to prevent the control line protector 106 and the plurality of control lines 107 from moving axially with respect to the body 103. The at least one axial securing pin member 109 may be, but is not limited to, a clamp, a body a fastener, a pin, a bolt, a set screw, or a screw. In one or more embodiments, the at least one axial securing member 109 is integral to the body 103 or the control line protector 106. The at least one axial securing member 109 may be made of a metallic or a composite material.

The plurality of control lines 107 may be communicatively coupled the stage tool assembly 100 and/or one or more external devices. The plurality of control lines 107 may also supply power to the one or more sensors 108. The plurality of control lines 107 are disposed between the outer surface 116 of the body 103 and the rib 124. The plurality of control lines 107 may also be disposed in the cavity 126 formed by the channel 125 of the rib 124 and the outer surface 116 of the body 103. The plurality of control lines 107 may include, without limitation, instrumentation lines, power supply lines, or other lines used as necessary to communicatively couple the stage tool assembly 100 to and/or from one or more external devices.

Figure 4A:
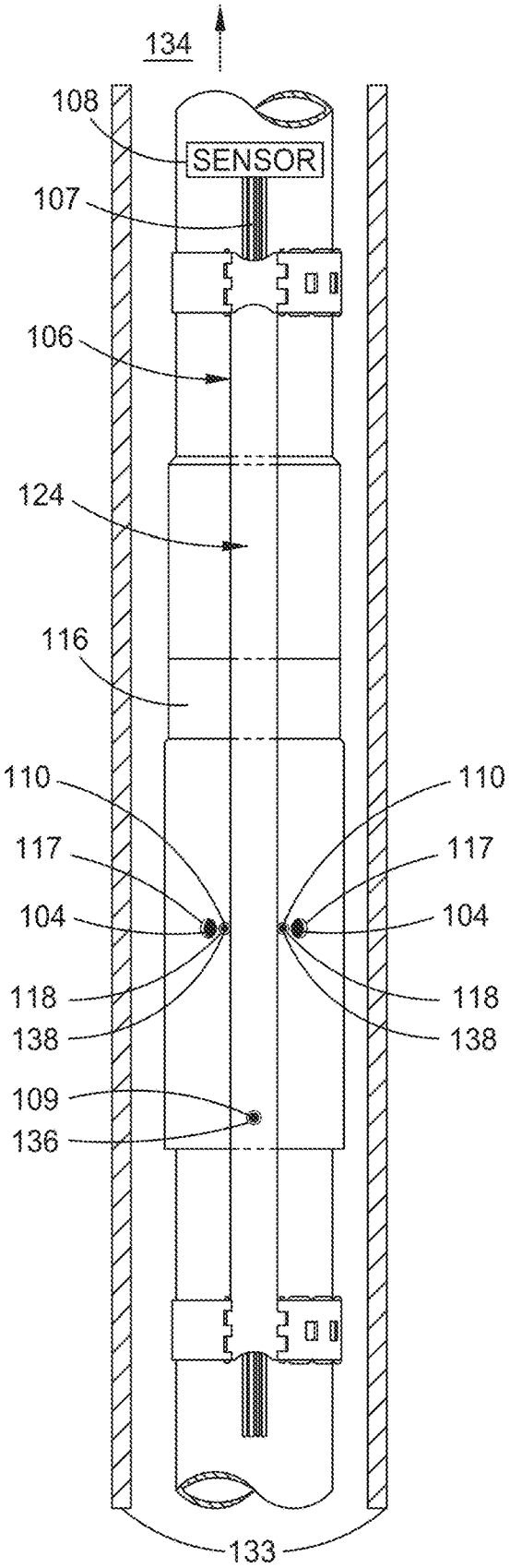
FIG. 4A-4C illustrates a method of cementing a wellbore using the stage tool assembly, according to one embodiment.
Figure 4B:
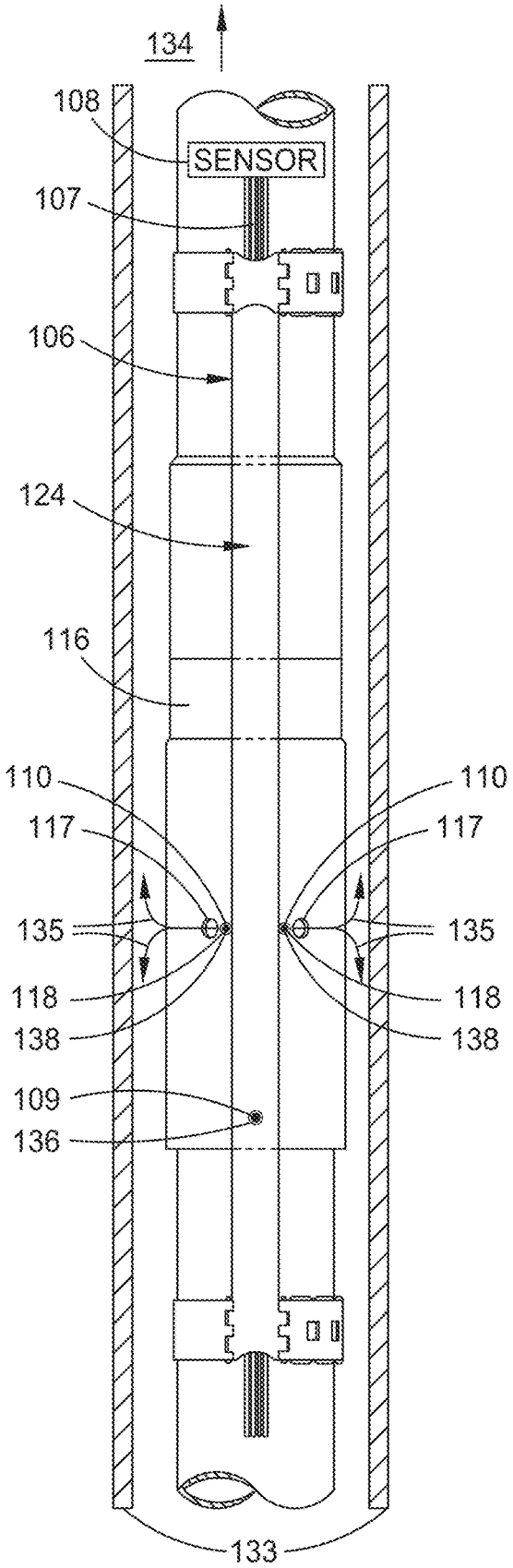
Figure 4C:
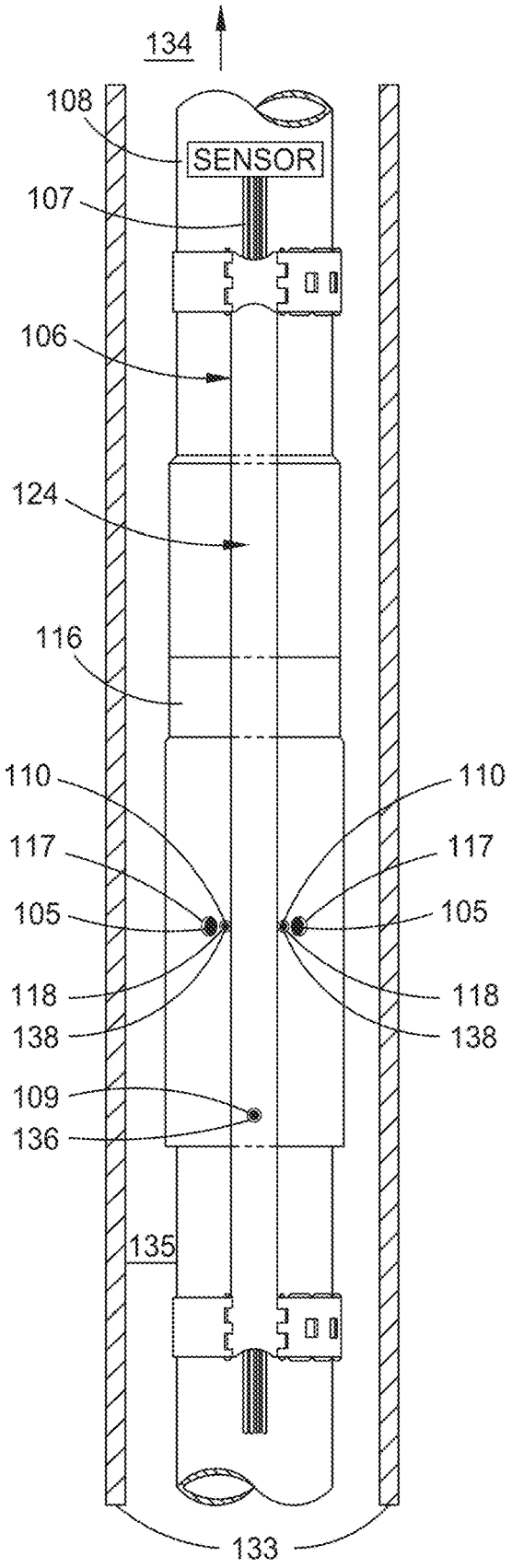

The one or more sensors 108 may be communicatively coupled to at least one of the plurality of control lines 107. At least one of the plurality of control lines 107 may supply power to the one or more sensors 108. The one or more sensors 108 may be disposed on and/or coupled to the body 103. The one or more sensors 108 may be disposed on the outer surface 116. The one or more sensors 108 may be drilled into the body 103. The one or more sensors 108 may be rigidly coupled to the body 103 through methods including, but not limited to welding, brazing, cementing, or fastening. The one or more sensors 108 may be configured to detect conditions of the stage tool assembly 100 including but not limited to leaks or cracks in the stage tool assembly 100. The one or more sensors 108 may be configured to detect conditions of a wellbore (such as wellbore 133 as shown in FIGS. 4A-4C) such as, but not limited to, cracks or leaks in the wellbore.

For example, the stage tool assembly 100 may be used to cement a wellbore that contains hazardous gases, such as CO2. The one or more sensors 108 may detect hazardous gases that flow up through the wellbore, such as CO2 that may leak through leak paths in the cemented portions of the wellbore (such as cement 135 shown in FIGS. 4A-4C) and/or the stage tool assembly 100, which may then flow up through the wellbore into undesired locations.

Figure 2:
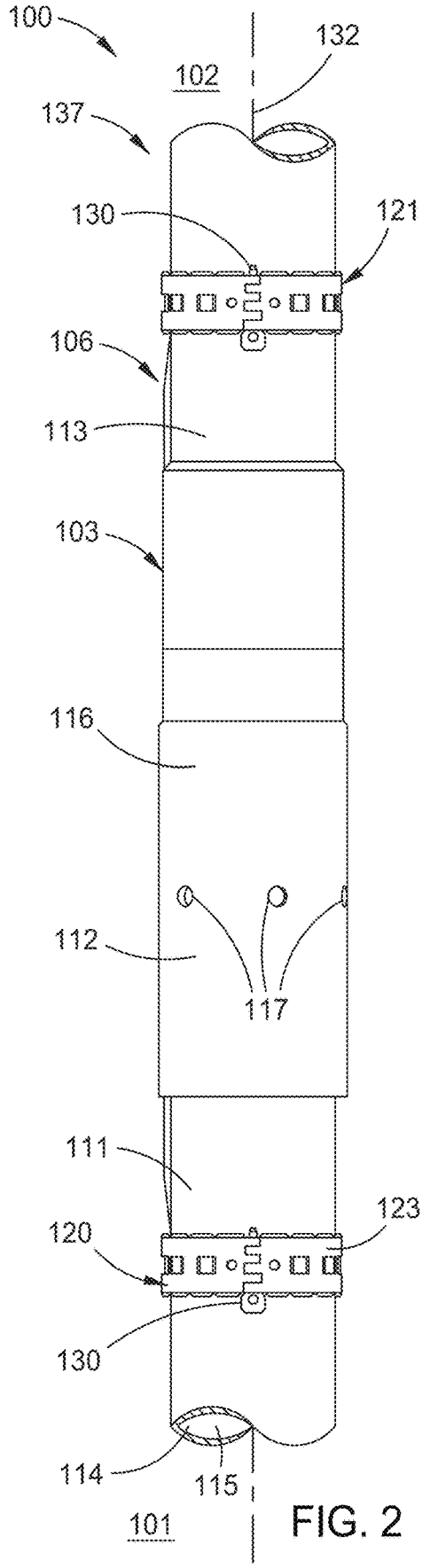
FIG. 2 is a side view of the stage tool assembly, according to one embodiment.

Referring to FIG. 2, the first clamps 122 and the second clamps 123 of the first and second collars 120, 121, respectively, may be coupled to each other by at least one taper pin 130. The first clamps 122 and second clamps 123 of the first and second collars 120, 121, respectively, may be coupled to the first and second ends 127, 128 of the rib 124 by one or more hinge pins 131. At least one of the hinge pins 131 may pivotally couple the first clamps 122 to one side of the first and second ends 127,128 of the rib 124, and at least another of the hinge pins 131 may couple the second clamps 123 to the other side of the first and second ends 127, 128 of the rib 124. The first clamps 123 and the second clamps 124 may then pivot about their respective coupling hinge pins 131 to clamp onto the outer surface 116 of body 103. The first clamp 122 and the second clamp 123 may then be coupled to one another by the at least one taper pin 130. The first clamps 122 and the second clamps 123 may completely circumscribe (e.g. make a complete circle around) the body 103 of the stage tool 137. In embodiments where the first clamps 122 and the second clamps 123 cannot completely circumscribe the body 103, there may be one or more clamp extenders that couples the first clamps 122 and the second clamps 123 together by adding circumference to allow the first collar 120 and second collar 121 to completely circumscribe the body 103.

Figure 3:
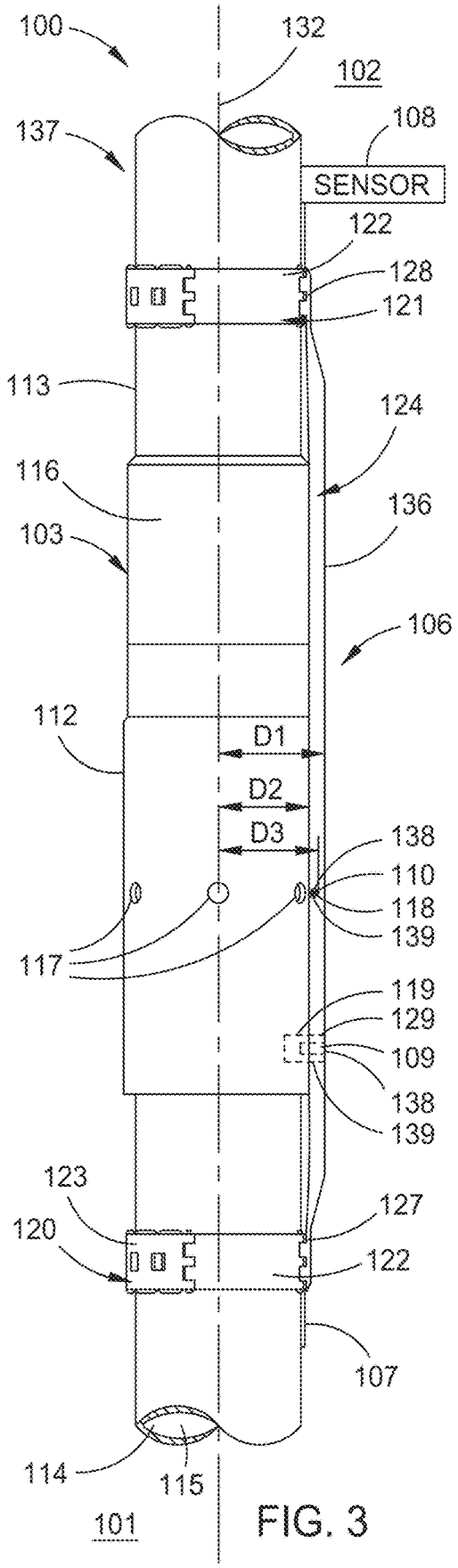
FIG. 3 is another side view of the stage tool assembly, according to one embodiment.

Referring to FIG. 3, the plurality of rotational securing pin members 110 are disposed in the plurality of rotational securing pin holes 118 and protrude from the outer surface 116 of the body 103 such that they prevent the rib 124, the control line protector 106, and the plurality of control lines 107 from rotating with respect to the body 103. The plurality of rotational securing pin members 110 may include, but are not limited to, fasteners, pins, bolts, set screws, or screws. The plurality of rotational securing pin members 110 may be coupled to the plurality of rotational securing pin holes 118 by methods including, but not limited to, welding, brazing, cementing, or screwing. In one or more embodiments, the plurality of rotational securing pin members 110 are integral to the body 103. The plurality of rotational securing pin members 110 may be made of a metallic or composite material.

The outer surface 136 of the rib 124 may extend a distance D1 from a central axis 132 of the stage tool assembly 100. The distance D1 may be the largest distance that any component of stage tool assembly 100 extends from the central axis 132 of stage tool assembly 100 such that the rib outer surface 136 is the furthest point from the central axis 132 of the stage tool assembly 100. The rib outer surface 136 may then be configured to be a contact portion if the stage tool assembly 100 were to contact the sidewalls of a wellbore. The outer surface 116 of the body 103 may extend a distance D2 from the central axis 132 of the stage tool assembly 100. The plurality of rotational securing pins 110 may protrude from the outer surface 116 of body 103 such that the end of the plurality of rotational securing pins 110 extend a distance D3 from the central axis 132 of the stage tool assembly 100. The distance D3 may be larger than distance D2 but less than distance D1. The plurality of rotational securing pins 110 extending the distance D3, between the distance D2 and the distance D1, prevents rotation of rib 124, the control line protector 106, and the control lines 107 without the plurality of securing pin members 110 becoming the outermost contact point of the stage tool assembly 100.

Referring to FIGS. 4A-4C, the stage tool assembly 100 may be used for cementing a wellbore 133. Only a portion of the stage tool assembly 100 and the wellbore 133 is shown in FIGS. 4A-4C. The stage tool assembly 100 may be part of a drill or cementing string assembly that comprises multiple pipes and/or multiple other tool assemblies coupled together for drilling or cementing the wellbore 133. The drill or cementing string assembly may also comprise one or more stage tool assemblies 100 coupled together.

Referring to FIG. 4A, the stage tool assembly 100 may be lowered into the wellbore 133 in a blocking configuration such that the plurality of port holes 117 are closed. The plurality of port holes 117 may be closed by a first blocking member 104 of the stage tool 137 that prevents fluid flow through the plurality of port holes 117. The first blocking member 104 may be disposed inside of the bore 114 of the body 103. The first block member 104 may be a blocking sleeve. The stage tool assembly 100 in the blocking configuration may then be lowered in a downhole direction 134 into the wellbore 133 to a desired depth.

Referring to FIG. 4B, the stage tool assembly 100 is actuated into an unblocked configuration to open the plurality of port holes 117. The plurality of port holes 117 may be opened by moving the first blocking member 104 such that fluid is allowed to flow through the plurality of port holes 117. Actuating the stage tool assembly 100 into the unblocked configuration may comprise pumping a device (such as an opening ball or plug) through the bore 114 of the stage tool assembly 100 from the uphole side 101 to push the first blocking member 104 towards the downhole side 102 and out of the way of the plurality of port holes 117. Actuating the stage tool assembly 100 into the unblocked configuration may also comprise shearing shear pins axially fixing the first blocking member 104 with respect to the body 103. Shearing of the shear pins may include, but is not limited to, pressurizing the uphole side 101 of the blocking member 104 and/or applying a force to the uphole side 101 of the blocking member 104.

When the stage tool assembly 100 is moved into the unblocked configuration, cement 135 is pumped through the bore 114 of the stage tool assembly 100 and is flowed out of the plurality of port holes 117 and into the annulus created between the stage tool assembly 100 and the wellbore 133. The control line protector 106 and the plurality of securing pin members 138 are configured to prevent the control lines 107 from crossing or moving into the flow of cement 135 out from the plurality of port holes 117, which can potentially erode or damage the control lines 107. The cement 135 may harden in the annulus created between the stage tool assembly 100 and the wellbore 133, thereby fixing the stage tool assembly 100 in place relative to the wellbore 133 and sealing the wellbore 133. The control line protector 106, the plurality of control lines 107, the plurality of securing pin members 138, and the one or more sensors 108 are similarly cemented in the wellbore 133 but otherwise remain operational.

Referring to FIG. 4C, the stage tool assembly 100 is actuated into a second blocked configuration to re-close the plurality of port holes 117. The plurality of port holes 117 may be closed by moving a second blocking member 105 to prevent fluid through the plurality of port holes 117. Actuating the stage tool assembly 100 into the second blocked configuration stops cement 135 and/or any other fluids from flowing out of or into the plurality of the port holes 117. The second blocking member 105 is disposed in the bore 114 of the body 103. The second blocking member 105 may be a blocking sleeve similar to first blocking member 104. The second blocking member 105 may have a larger outer diameter than the first blocking member 104. Actuating the stage tool assembly 100 into the second blocked configuration may comprise pumping a device (such as a closing ball or plug) through bore 114 of the stage tool assembly 100 from the uphole side 101 to push the second blocking member 105 towards the downhole side 102 and into the way of the plurality of port holes 117. Actuating the stage tool assembly 100 into the second blocked configuration may comprise shearing shear pins axially fixing the second blocking member 105 with respect to the body 103. Shearing of the shear pins may include, but is not limited to, pressurizing the uphole side 101 of the second blocking member 105 and/or applying a force to the uphole side 101 of the second blocking member 105.

During lowering and/or when the stage tool 137 is cemented with the wellbore 133, power can be supplied through the one or more control lines 107 to the one or more sensors 108. The sensors 108 are configured to monitor one or more fluids within the wellbore 133. The sensors 108 are also configured to send a signal through the one or more control lines 107 indicating that a hazardous gas, such as $CO_2$, has been detected. The presence of hazardous gas detected by the one or more sensors 108 may provide an indication that there is a leak within the cement of the wellbore 133 and/or the stage tool 137, and that remedial action may be taken by an operator of the wellbore 133 if needed.

The steps of the method of cementing the wellbore 133 as illustrated in FIGS. 4A-4C may be done automatically based on a number of inputs including wellbore 133 conditions or be may be done by manual operator input.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

We claim:

1. A method of cementing a wellbore, comprising:

lowering a stage tool assembly into the wellbore, wherein the stage tool assembly comprises a stage tool, a control line protector coupled to the stage tool, a plurality of control lines disposed between the control line protector and the stage tool, one or more sensors coupled to the plurality of control lines, and one or more securing pin members disposed in an outer surface of the stage tool that prevent rotation of the control line protector relative to the stage tool;

opening a plurality of port holes of the stage tool to allow fluid flow through the plurality of port holes;

pumping cement through the stage tool assembly and out of the plurality of port holes and into the wellbore; and closing the plurality of port holes of the stage tool to prevent fluid flow through the plurality of port holes.

2. The method of claim 1, wherein the plurality of control lines are prevented from moving with respect to the stage tool by the control line protector and the one or more securing pin members.

3. The method of claim 2, wherein the one or more securing pin members comprises a plurality of rotational securing pin members disposed on opposite sides of the control line protector that prevent rotational movement of the control line protector with respect to the stage tool.

4. The method of claim 2, wherein the one or more securing pin members comprises at least one axial securing pin member disposed through the control line protector to prevent axial movement of the control line protector with respect to the stage tool.

5. The method of claim 1, wherein lowering the stage tool assembly into the wellbore comprises lowering the stage tool assembly with the plurality of port holes closed.

6. The method of claim 1, further comprising supplying power through the one or more control lines to the one or more sensors.

7. The method of claim 6, further comprising monitoring one or more fluids within the wellbore using the sensors.

8. The method of claim 7, further comprising sending a signal from the one or more sensors through the one or more controls lines indicating that a hazardous gas has been detected within the wellbore.

9. The method of claim 1, wherein opening the plurality of port holes of the stage tool comprises moving a first blocking member of the stage tool such that fluid is allowed to flow through the plurality of port holes.

10. The method of claim 1, wherein closing the plurality of port holes of the stage tool comprises moving a second blocking member of the stage tool such that fluid is prevented from flowing through the plurality of port holes.

11. The method of claim 1, wherein the stage tool further comprises:

a body having a bore;

the plurality of port holes disposed through an outer surface of the body; and a plurality of securing pin holes disposed on the outer surface of the body.

12. The method of claim 11, wherein the control line protector further comprises:

a first collar and a second collar; and a rib coupled to the first collar and the second collar, wherein the plurality of control lines are disposed between the rib and the outer surface of the body, wherein the one or more sensors are disposed on an outer surface of the body, wherein the plurality of control lines are configured to supply power to the one or more sensors, and wherein the one or more securing pin members are disposed in the plurality of securing pin holes to prevent the control line protector from moving relative to the body.

13. The method of claim 12, wherein the one or more securing pin members protrude from the plurality of securing pin holes a distance from a central axis of the stage tool that is less than a distance from the central axis of the stage tool to an outer surface of the rib and larger than a distance from the central axis to the outer surface of the body.

14. The method of claim 12, further comprising positioning at least two of the one or more securing pin members on either side of the rib to prevent the control line protector from rotating with respect to the body.

15. The method of claim 12, further comprising positioning at least one of the one or more securing pin members through the rib to prevent the control line protector from moving axially with respect to the body.

16. The method of claim 12, wherein the rib comprises a channel that creates a cavity between the rib and the outer surface of the body.

17. The method of claim 12, wherein the plurality of securing pin holes are located at a same axial position as the plurality of port holes with respect to the body.

18. The method of claim 12, wherein the plurality of securing pin holes are located at a different axial position as the plurality of port holes with respect to the body.

19. The method of claim 12, wherein the control line protector is rotationally fixed on the body and positioned between a first port hole and a second port hole of the plurality of port holes to prevent the control line protector and the control lines from rotating with respect to the body.

20. The method of claim 12, wherein the one or more securing pin members comprises a plurality of rotational securing pin members and at least one axial securing pin member, wherein the plurality of rotational securing pin members prevent the control line protector from rotating with respect to the body, and wherein the at least one axial securing pin member prevents the control line protector from axially moving with respect to the body.

* * * * *